US005833773A

United States Patent [19]

Bewlay et al.

[11] Patent Number: 5,833,773

[45] Date of Patent: Nov. 10, 1998

[54] NB-BASE COMPOSITES

[75] Inventors: Bernard Patrick Bewlay, Schenectady; Melvin Robert Jackson, Niskayuna, both of N.Y.

[73] Assignee: General Electric Company, Schenectady, N.Y.

[21] Appl. No.: 498,826

[22] Filed: Jul. 6, 1995

[51] Int. Cl.[6] ..... C22C 27/02

[52] U.S. Cl. ..... 148/422; 420/426; 420/588; 148/442

[58] Field of Search ..... 148/422; 420/426, 420/588

[56] References Cited

U.S. PATENT DOCUMENTS

| | | | |
|---|---|---|---|
| 3,028,236 | 4/1962 | Wlodek et al. | 420/426 |
| 3,037,858 | 6/1962 | Weisert et al. | 420/426 |
| 4,956,144 | 9/1990 | Jackson | 420/426 |
| 4,990,308 | 2/1991 | Jackson | 420/426 |
| 5,006,307 | 4/1991 | Jackson | 420/426 |
| 5,296,309 | 3/1994 | Benz et al. | 420/426 |
| 5,316,865 | 5/1994 | Benz et al. | 420/426 |
| 5,366,565 | 11/1994 | Jackson | 148/422 |

*Primary Examiner*—John Sheehan
*Attorney, Agent, or Firm*—Ernest G. Cusick; William H. Pittman

[57] ABSTRACT

Nb-base alloys that include Ti, Hf, Cr, Al and Si as alloy constituents have a microstructure that includes a metallic solid solution phase and a mixture of intermetallic silicide phases. The metal silicide phases include an $M_3Si$ silicide, where M comprises Nb, Ti or Hf, and an $M_5(Si, Al)_3$ silicide, where M comprises Nb, Ti or Hf. These alloys have mechanical properties such as low temperature fracture toughness, high temperature fracture strength, high temperature stress rupture strength and high temperature creep resistance, that meet or exceed those of certain Ni-base superalloys.

20 Claims, 2 Drawing Sheets

NB-BASE COMPOSITES

FIELD OF THE INVENTION

This invention is related generally to Nb-base alloys. The invention is particularly to directed to Nb-base alloys that contain Ti, Hf, Cr, Al and Si as alloy constituents.

BACKGROUND OF THE INVENTION

Alloys that are used to make the components of the hot section of a gas turbine engine (e.g. turbine blades and vanes), routinely are cycled from ambient temperatures and no applied load to average alloy operating temperatures of 900°–1000° C. or more (including localized alloy temperatures of about 1100°–1150° C.), and tensile loads of 50–70 MPa in the hot region, due to centrifugal stresses and additionally there are thermally-induced stresses created during rotation of the engine rotor. It is known that tensile and yield strength at high temperatures, high temperature stress rupture strength, fracture toughness at low temperatures and oxidation resistance are all important properties for these alloys. Presently, directionally solidified and single crystal Ni-base superalloys are used in these applications. These Ni-base superalloys and their properties are well-known, and are described in publications such as, G. L. Erickson, "A New, Third Generation, Single-Crystal, Casting Superalloy", Journal of Materials, Apr. 1995 (pp. 36–39) and K. Harris, et al., "Directionally Solidified and Single-Crystal Superalloys", Metals Handbook Tenth Edition, Volume 1, 1990, (pp. 995–1006). Much effort has been directed to the improvement of Ni-base superalloys, so as to permit higher engine operating temperatures, because engine efficiency is known to be directly related to the engine operating temperature. The preceding references describe, for example, a desire to develop alloys that have mechanical properties that are sufficient to permit operating temperatures of >1200° C. However, while improvements continue to be made to these alloys which expand their operating temperatures, there are other intrinsic properties of these alloys that continue to provide an impetus for the consideration of other alloy systems.

One such property is the density of Ni-base alloys, which ranges from about 8.1–9.3 g/cm$^3$. Engine components (e.g., turbine blades and vanes) made from alloys with equivalent or superior mechanical properties as compared to Ni-base superalloys that are less dense, would directly improve the operating efficiency of an engine. The use of less dense components would likely also indirectly improve engine efficiency by permitting the redesign and reduction in weight of related components (e.g., turbine disks). Further, at a given set of operating conditions, components with equivalent mechanical properties and lower densities have lower operational stresses (e.g., centrifugal forces), thereby potentially making possible higher operating temperatures. Lower density materials, including composite materials such as intermetallic matrix composites and ceramic matrix composites, are also being developed for these applications, but are not presently in commercial use.

Therefore, it is desirable to develop alloys that have mechanical properties such as higher temperature stress rupture strength, high temperature tensile and yield strength and low temperature toughness that are greater than or equal to Ni-base superalloys, particularly alloys that have a density that is less than or equal to Ni-base superalloys.

SUMMARY OF THE INVENTION

The present invention describes Nb-base alloys or composites (The composition will be referred to in the following description of the invention as an alloy in order to simplify the description. However, this is not meant to limit the invention in any way.) comprising Ti, Hf, Cr, Al and Si as alloy constituents. These alloys are characterized by the fact that they have a microstructure comprising a metallic Nb-base phase and an intermetallic metal silicide phase. The metal suicides comprise an $M_3Si$ silicide, where M comprises Nb, Ti or Hf, and an $M_5(Si, Al)_3$ silicide, where M comprises Nb, Ti or Hf. Alloys of this invention are essentialy metal matrix composites that combine high-strength, low-toughness silicides with a lower strength high toughness Nb-based metallic phase, where the composites are formed in situ by the directional-solidification of the alloy. These alloys generate a composite that has improved high-temperature and low-temperature mechanical properties. For example, an alloy of this invention exhibited a room temperature fracture toughness of ≧20 MPa√m, a tensile fracture strength at 1000°–1200° C. of ≧350 MPa, a tensile strength at ambient temperature of ≧500 MPa and a stress rupture life of ≧20 hours at 1100° C. and a stress of 140 MPa. Alloys of the present invention are also characterized by having a density of about 7.0–7.4 g/cm$^3$, which is less than the density of Ni-base superalloys.

DETAILED DESCRIPTION OF THE INVENTION

Figure 1:
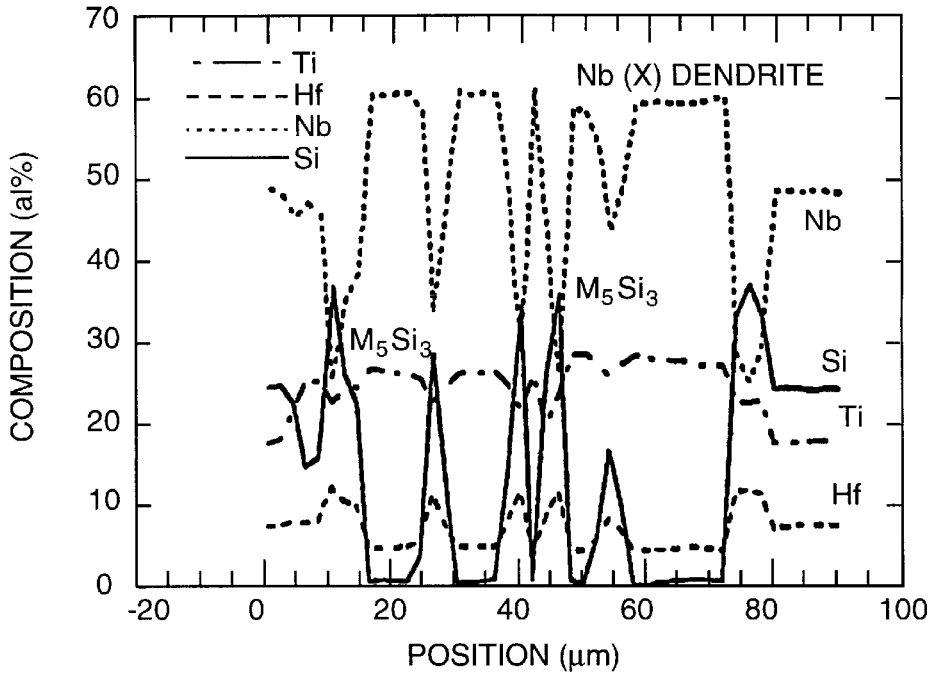
FIG. 1 is a plot of composition as a function of location within an alloy of the present invention.

The present invention includes Nb-base alloys comprising Ti, Hf, Cr, Al and Si as alloy constituents, that are characterized by having a microstructure comprising a metallic Nb-base phase and a metal silicide phase, as more particularly described herein. Such alloys are particularly advantageous, in that they have properties, such as high temperature tensile and yield strength and high temperature stress rupture strength that are greater than or equal to Ni-base superalloys. In addition, they also have a density that is less than Ni-base superalloys.

Alloys of the present invention are Nb-base alloys that have Ti, Hf, Cr, Al and Si as alloy constituents, with Ti, Si and Hf being the primary alloy constituents. These alloys are characterized by a microstructure comprising a metallic Nb-base phase and an intermetallic metal silicide phase, with the metallic phase being relatively more ductile and the intermetallic silicide being more brittle and stronger. Alloys of the present invention may also be viewed as a composite of a ductile metallic phase and a brittle strengthening phase, wherein the composite is formed in-situ upon solidification of the alloy. The Si constituent is used to form the intermetallic silicide. The Ti and Hf alloy constituents improve the high temperature oxidation resistance as compared to Nb-base alloys containing only Si. The Ti improves the intrinsic ductility of the metallic phase. The Hf is also a strong solid solution strengthener of the Nb-based metallic phase. Both Ti and Hf also form suicides. The Cr and Al constituents improve the oxidation resistance of both the metallic and silicide phases. The Al also forms an aluminide with the Nb, Ti and Hf. All elements partition to varying degrees between the different phases of the composite.

Alloys of this invention have a metal phase comprising a solid solution of Nb, Ti, Hf, Si, Al and Cr. The metal silicide phase comprises a mixture of an $M_3Si$ silicide, where M comprises Nb, Ti or Hf, and an $M_5(Si, Al)_3$ silicide, where M comprises Nb, Ti or Hf. In order to maintain a metallic phase, alloys of the present invention should contain less than 25 atomic percent Si, with lower limits dictated by the volume fraction of the silicide phase desired. Alloys of the present invention may be directionally solidified, and these directionally solidified alloys have mechanical properties that are equivalent to, and in some cases exceed, those of Ni-base superalloys, as described further herein. Alloys of the present invention are also less dense than Ni-base superalloys, having an expected density in the range of 7.0–7.4 g/cm$^3$, as discussed further herein.

EXAMPLE 1

This example describes the microstructure, phase compositions, and mechanical properties of a complex silicide alloy of the present invention. The composition of the alloy was Nb-24.7 Ti-8.2 Hf-2.0 Cr-1.9 Al-16.0 Si and was based on the binary Nb-16% Si composition. The alloy was prepared from the pure metals by triple melting the metals in a water cooled copper crucible, wherein the metals were heated by induction. Triple melting was employed to improve the homogeneity of the alloy. The density of this alloy was 7.2 g/cm$^3$.

Samples of this alloy composition were directionally solidified using a Czochralski-type technique, wherein a seed of the alloy was used as the substrate to extract the directionally-solidified alloy from the melt and form an aligned composite of what was later identified as three phases (M, $M_3Si$ and $M_5Si_3$). Mechanical property measurements included room temperature fracture toughness, tensile strength from room temperature to 1200° C. and tensile creep data at temperatures up to 1100 ° C. The improved toughness of the directionally-solidified alloy allowed machining of the tensile-testing samples using conventional machining techniques.

The microstructure of the alloy (not shown) contained both metallic and $M_3Si$ intermetallic dendrites, a small amount of an $M_5Si_3$, and an interdendritic eutectic of $M_3Si$ and metal. The metallic dendrites were aligned with the growth direction. The volume fraction of the metallic phase was 54%. The average dendrite size of the metallic phase, including the secondary arms, was ~24 $\mu$m. The $M_3Si$ dendrites were also aligned with the growth direction and possessed the typical faceted morphology that has been observed in binary hypereutectic Nb-Si alloys and the ternary Nb—Ti—Si composites.

Electron microprobe analysis confirmed that the composite alloy consisted of three phases: a metallic phase containing Nb, Ti, Hf, Si, Al and Cr, an $M_3Si$ silicide phase, and also an $M_5(Si,Al)_3$ phase (where M represents Nb, Ti and Hf). The composition ranges observed in the individual phases are shown in Table 1 in atom percent. The Si concentrations of the $M_3Si$ and $M_5Si_3$ silicides were close to the stoichiometric values.

TABLE 1

| Nb | Ti | Hf | Si | Al | Cr |
|---|---|---|---|---|---|
| | | Metal Solid Solution | | | |
| 58–61 | 27.2–29.4 | 5.0–5.3 | 0.9–1.3 | 2.5–3.0 | 2.8–3.9 |
| | | $M_3Si$ Solid Solution | | | |
| 48.3–49.0 | 18.2 | 7.8 | 24.7–25.4 | 0.1 | 0.13–0.16 |
| | | $M_5Si_3$ Solid Solution | | | |
| 25.5–27.9 | 22.2–23.2 | 12.5–12.9 | 35.4–37.5 | 1.0–1.5 | 0.35–0.5 |

A microprobe scan perpendicular to the growth direction is shown in FIG. 1. The Ti profile was almost uniform across the dendrites perpendicular to the growth direction and there was some Ti depletion in the interdendritic regions. There is strong Hf segregation from the metallic phase to the $M_5(Si, Al)_3$ and $M_3Si$ suicides. Hf segregation results in only small differences in the average atomic weight of the different phases, therefore it is difficult to obtain significant contrast between them using BSE imaging. The Hf partitioning results observed were 5% Hf in the metallic phase, 8% Hf in $M_3Si$, 12.5% Hf in $M_5(Si,Al)_3$ ; the bulk Hf composition in the alloy was nominally 8.2%. The Nb:Ti ratio was ~2:1 in the metallic phase. In the $M_5(Si,Al)_3$ the Nb:Ti:Hf:Si ratio was 2:2:1:3. Very low concentrations of Al and Cr were observed in both the $M_3Si$ and $M_5(Si,Al)_3$ suicides.

In the directionally-solidified condition, this alloy had a room temperature fracture toughness of 19 to 22 MPa√m. Typically, the initiation toughness values were 7 to 13 MPa√m, and the $K_{Ic}$ values were 19 to 22 MPa√m. Typical fracture toughness values ($K_{Ic}$) for intermetallic phases are <10 MPa√m, and a value of about 20 MPa√m is commonly accepted as the minimum useful fracture toughness for materials used in gas turbine applications.

Fracture toughness specimens of the directionally-solidified Nb—Ti—Hf—Cr—Al—Si alloy (not shown) were characterized by a convoluted fracture surface consistent with a high work of fracture. The metallic dendrites failed in a ductile manner and were pulled out of the matrix. The metallic phase between the silicide dendrites was also pulled to a chisel point with microcracking of the silicide matrix. All of the $M_3Si$ and $M_5Si_3$ intermetallic dendrites failed by cleavage.

Figure 2:
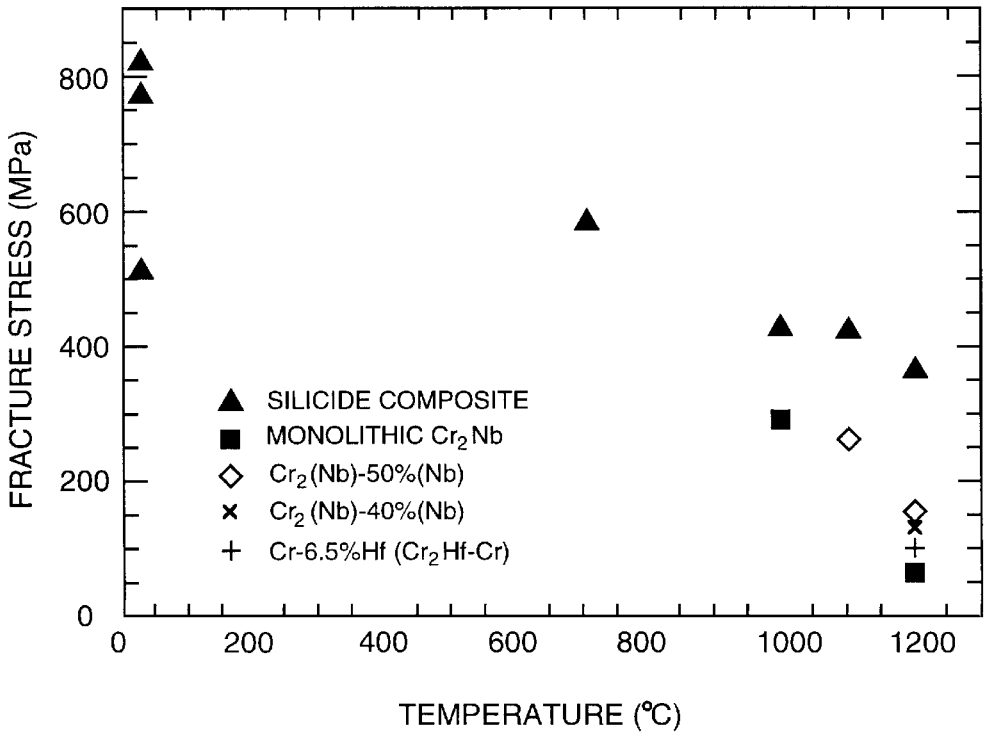
FIG. 2 is a plot of tensile fracture stress as a function of temperature for an alloy of the present invention.

The tensile stress is shown as a function of temperature in FIG. 2, and in Table 2. The room-temperature tensile fracture stress was ~750 MPa. The tensile fracture strength between 1000°–1200° C. ranged between about 350–450 MPa. The tensile yield stress of the composite at 1200 ° C. was 300 MPa, and an elongation of 19% was measured indicating significant plastic deformation of both the metallic and silicide phases. Monolithic alloys of similar compositions to the metallic phase of the composite have a yield strength of less than 55 MPa at 1200 ° C. Thus the composite possesses substantially improved tensile properties. At 1100 ° C. only 2% elongation was measured for the composite. At temperatures below 1100 ° C., essentially no tensile elongation was measured. At room temperature, the metallic phase provides the composite with most of its toughness, whereas at elevated temperature (>1000 °C.) the silicide phases are providing the composite with its strength. The volume fraction of silicide in the above composite can be increased to improve the high-temperature strength and oxidation resistance, but this may compromise the attractive room temperature toughness. Typical ambient tensile strength values for Ni-base superalloys used in blade applications range from about 860–1100 MPa, while tensile strengths for these alloys at 1200° C. range from about 35–350 MPa.

TABLE 2

| Temperature (°C.) | Fracture Strength (MPa) |
|---|---|
| 25 | 770 |
| 700 | 590 |
| 1000 | 429 |
| 1100 | 425 |
| 1200 | 370 |

Figure 3:
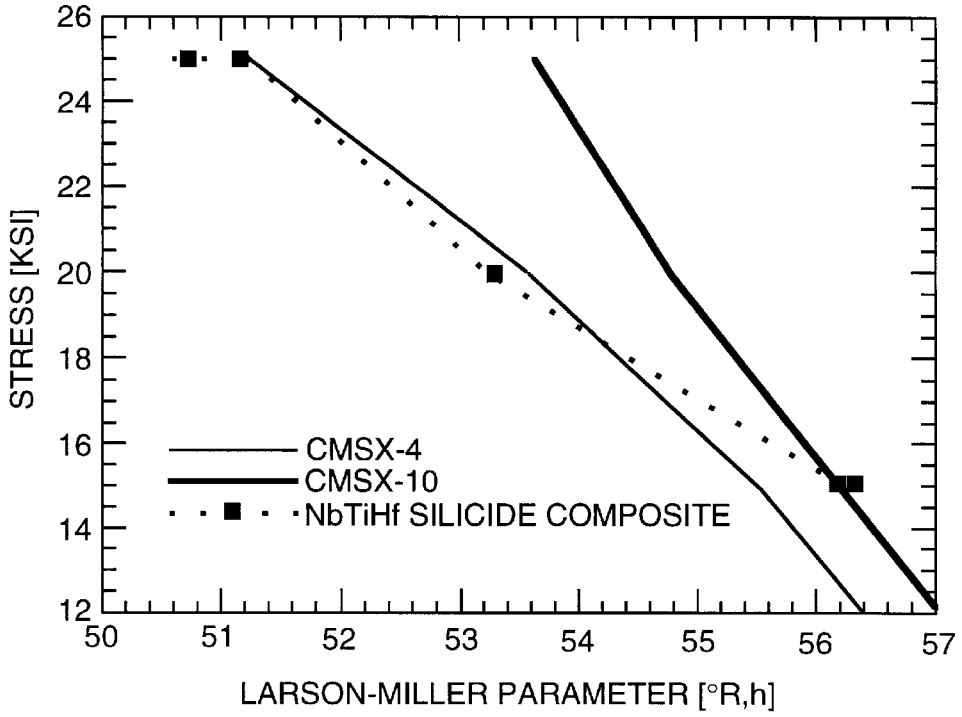
FIG. 3 is a plot of stress as a function of the Larson-Miller parameter for an alloy of the present invention.
Figure 4:
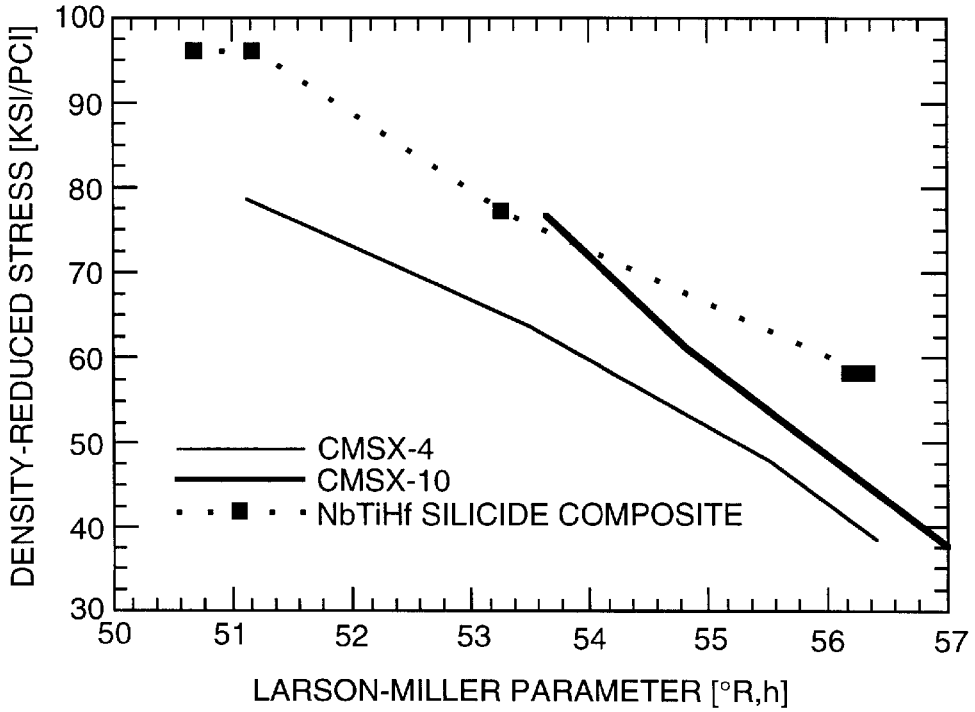
FIG. 4 is a plot of stress normalized for alloy density as a function of the Larson-Miller parameter for an alloy of the present invention.

Tensile creep data of the Nb—Ti—Hf—Cr—Al—Si composite are shown in Table 3. At 1100 ° C. and 105 MPa the stress rupture life was greater than 500 hours. Stresses higher than 105 MPa led to shorter rupture times at either 1000 or 1100 ° C. The rupture behavior of the Nb—Ti—Hf—Cr—Al—Si composite is shown in the Larson-Miller plot in FIG. 3 and is compared to an early generation directionally-solidifed Ni-based superalloy (CMSX-4) and a current generation single-crystal Ni-based superalloy (CMSX- 10). These alloys are well-known, having their compositions reported in the Ni-base superalloy references cited herein. The stress rupture behavior is similar to that of advanced single crystal Ni-based superalloys under similar conditions. FIG. 4 shows the same data normalized for the alloy density, and reveals an improvement over the single crystal Ni-base superalloys.

TABLE 3

| Temperature:Stress (°C.):(MPa) | Rupture Life (Hours) | Creep Rate ($s^{-1}$) | $\epsilon_f$ (%) |
|---|---|---|---|
| 1100:140 | 35 | $1.7 \times 10^{-7}$ | 7 |
| 1100:105 | 584,524 | $9.3 \times 10^{-9}$ | 9.1,10 |
| 1000:175 | 129,212 | $2.9 \times 10^{-8}$ | 4.5,6.0 |

Other alloy compositions have also been prepared using methods similar to those described above. These alloys had the compositions $Nb_{40.69}Ti_{26.87}Hf_{7.23}Cr_{6.01}A_{13.16}Si_{6.04}$ and $Nb_{38.8}Ti_{26.2}Hf_{7.75}Cr_{5.25}Al_{3.0}Si_{19.0}$, thus defining a range including the alloy described above of compositions for alloys of the present invention of about $Nb_{38\text{-}48}Ti_{24\text{-}27}Hf_{7.0\text{-}8.5}Cr_{1.5\text{-}6.5}Al_{1.5\text{-}3.5}Si_{15\text{-}20}$.

This composite alloy combines high-strength, low-toughness suicides with a lower strength high toughness Nb-based metallic phase and generates a composite that has improved high-temperature and low-temperature mechanical properties. Room-temperature fracture toughness values of >20 MPa√m were measured with a tensile strength of >350 MPa at 1200 °C. Both the metallic and silicide phases are designed for improved high-temperature environmental resistance. The properties of these alloys make them well-suited for applications above 1000° C.

What is claimed is:

1. A Nb base composite comprising, Hf, Cr, Al and Si as constituents, said composite having a microstructure comprising a metallic Nb-base phase and a metal silicide phase.

2. The composite of claim 1, wherein the metal silicide phase of said composite comprises an $M_3Si$ silicide, where M comprises Nb, Ti or Hf.

3. The composite of claim 1, wherein the metal silicide phase of said composite comprises an $M_5(Si, Al)_3$ silicide, where M comprises Nb, Ti or Hf.

4. The composite of claim 1, wherein said composite has a composition in atomic percent within the range defined by:

$Nb_{38\text{-}48}Ti_{24\text{-}27}Hf_{7.0\text{-}8.5}Cr_{1.5\text{-}6.5}Al_{1.5\text{-}3.5}Si_{15\text{-}20}$.

5. The composite of claim 1, wherein Si comprises 10–21 atomic percent of the composite.

6. The composite of claim 1, wherein said composite is directionally solidified.

7. The composite of claim 5, wherein said composite has a room temperature fracture toughness of ≧20 MPa√m.

8. The composite of claim 5, wherein said composite has a tensile fracture strength at 1000°–1200° C. of ≧350 MPa.

9. The composite of claim 5, wherein said composite has a tensile strength at ambient temperature of ≧500 MPa.

10. The composite of claim 5, wherein said composite has a stress rupture life of ≧560 hours at 1100° C. and a stress of 105 MPa.

11. A method for forming a Nb base composite, the composite comprising Nb, Ti, Hf, Cr, Al and Si as constituents, the method comprising:

providing each of the constituents; and directionally solidifying the composite to form a microstructure comprising a metallic Nb-base phase and a metal silicide phase.

12. The method of claim 11, wherein the metal silicide phase of said composite comprises an M3Si silicide, where M comprises Nb, Ti or Hf.

13. The method of claim 11, wherein the metal silicide phase of said composite comprises an $M_5(Si, Al)_3$ silicide, where M comprises Nb, Ti or Hf.

14. The method of claim 11, wherein said composite has a composition in atomic percent within the range defined by:

$Nb_{38\text{-}48}Ti_{24\text{-}27}Hf_{7.0\text{-}8.5}Cr_{1.5\text{-}6.5}Al_{1.5\text{-}3.5}Si_{15\text{-}20}$.

15. The method of claim 11, wherein Si comprises 10–21 atomic percent of the composite.

16. The method of claim 15, wherein said composite has a room temperature fracture toughness of ≧20 MPa√m.

17. The method of claim 15, wherein said composite has a tensile fracture strength at 1000°–1200° C. of ≧350 MPa.

18. The method of claim 15, wherein said composite has a tensile strength at ambient temperature of ≧500 MPa.

19. The method of claim 15, wherein said composite has a stress rupture life of ≧560 hours at 1100° C. and a stress of 105 MPa.

20. The composite of claim 4, wherein said composite has a composition in atomic percent defined by:

$Nb_{47.20}Ti_{26.67}Hf_{8.21}Cr_{1.99}Al_{1.939}Si_{16}$.

* * * * *